US006170931B1

(12) United States Patent
Anderson et al.

(10) Patent No.: US 6,170,931 B1
(45) **Date of Patent: *Jan. 9, 2001**

(54) INK JET HEATER CHIP MODULE INCLUDING A NOZZLE PLATE COUPLING A HEATER CHIP TO A CARRIER

(75) Inventors: Frank Edward Anderson, Sadieville; Ashok Murthy, Lexington, both of KY (US)

(73) Assignee: Lemark International, Inc., Lexington, KY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/100,218

(22) Filed: Jun. 19, 1998

(51) Int. Cl.[7] ..... B41J 29/38
(52) U.S. Cl. ..... 347/17
(58) Field of Search ..... 347/17, 63, 65

(56) References Cited

U.S. PATENT DOCUMENTS

| | | | |
|---|---|---|---|
| 4,357,614 | 11/1982 | Tamai . | |
| 4,558,333 | 12/1985 | Sugitani et al. . | |
| 4,605,939 | 8/1986 | Hubbard et al. . | |
| 4,639,748 | 1/1987 | Drake et al. . | |
| 4,866,461 * | 9/1989 | Piatt | 347/65 |
| 5,257,043 | 10/1993 | Kneezel . | |
| 5,278,584 * | 1/1994 | Keefe et al. | 347/63 |
| 5,291,226 | 3/1994 | Schantz et al. . | |
| 5,297,331 | 3/1994 | Childers . | |
| 5,408,738 | 4/1995 | Schantz et al. . | |
| 5,469,199 | 11/1995 | Allen et al. . | |
| 5,574,488 * | 11/1996 | Tamura | 347/63 |
| 5,625,396 | 4/1997 | Keefe et al. . | |
| 5,659,343 | 8/1997 | Koizumi et al. . | |

FOREIGN PATENT DOCUMENTS

| | | |
|---|---|---|
| 0 822 078 A2 | 2/1998 | (EP) . |
| 0 822 080 A2 | 2/1998 | (EP) . |

* cited by examiner

*Primary Examiner*—John Barlow
*Assistant Examiner*—Charles W. Stewart, Jr.
(74) *Attorney, Agent, or Firm*—John A. Brady

(57) ABSTRACT

A heater chip module is provided comprising a rigid carrier, a nozzle plate and a heater chip. The carrier is adapted to be secured to a container for receiving ink. The carrier includes an opening extending completely through the carrier. The opening has an outer periphery. A nozzle plate is coupled to the carrier and extends out beyond the outer periphery of the opening so as to substantially cover the opening. A heater chip is positioned within the opening and is coupled directly to the nozzle plate. The heater chip is coupled to the carrier only by way of the nozzle plate. Thus, the heater chip does not directly contact the carrier.

13 Claims, 2 Drawing Sheets

INK JET HEATER CHIP MODULE INCLUDING A NOZZLE PLATE COUPLING A HEATER CHIP TO A CARRIER

CROSS-REFERENCE TO RELATED APPLICATIONS

This application is related to contemporaneously filed U.S. patent applications Ser. No. 09/100,070, entitled "AN INK JET HEATER CHIP MODULE WITH SEALANT MATERIAL," U.S. Ser. No.09/100,485, entitled "A HEATER CHIP MODULE AND PROCESS FOR MAKING SAME," U.S. Ser. No. 09/099,854, entitled "A PROCESS FOR MAKING A HEATER CHIP MODULE," U.S. Ser. No. 09/100,538, entitled "A HEATER CHIP MODULE FOR USE IN AN INK JET PRINTER," and U.S. Ser. No. 09/100,544, entitled "AN INK JET HEATER CHIP MODULE," the disclosures of which are incorporated herein by reference.

FIELD OF THE INVENTION

This invention relates to an ink jet heater chip module adapted to be secured to an ink-filled container.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printer's printhead. The printhead typically comprises the heater chip and a nozzle plate having a plurality of the discharge nozzles formed therein. The printhead forms part of an ink jet print cartridge which also comprises an ink-filled container.

A plurality of dots comprising a swath of printed data are printed as the ink jet print cartridge makes a single scan across a print medium, such as a sheet of paper. The data swath has a given length and width. The length of the data swath, which extends transversely to the scan direction, is determined by the size of the heater chip.

Printer manufacturers are constantly searching for techniques which may be used to improve printing speed. One possible solution involves using larger heater chips. Larger heater chips, however, are costly to manufacture. Heater chips are typically formed on a silicon wafer having a generally circular shape. As the normally rectangular heater chips get larger, less of the silicon wafer can be utilized in making heater chips. Further, as heater chip size increases, the likelihood that a chip will have a defective heating element, conductor or other element formed thereon also increases. Thus, manufacturing yields decrease as heater chip size increases.

Accordingly, there is a need for an improved printhead or printhead assembly which allows for increased printing speed yet is capable of being manufactured in an economical manner.

SUMMARY OF THE INVENTION

In accordance with the present invention, a heater chip module is provided comprising a rigid carrier, a nozzle plate and a heater chip. The carrier is adapted to be secured to a container for receiving ink. The carrier includes an opening extending completely through the carrier. The opening has an outer periphery. A nozzle plate is coupled to the carrier and extends out beyond the outer periphery of the opening so as to substantially cover the opening. A heater chip is positioned within the opening and is coupled directly to the nozzle plate. The heater chip is coupled to the carrier only by way of the nozzle plate. Further, the heater chip does not directly contact the carrier.

Two or more heater chips, aligned end to end or at an angle to one another, may be coupled to a single carrier via one or two or more nozzle plates. Thus, two or more smaller heater chips can be combined to create the effect of a single, larger heater chip. That is, two or more smaller heater chips can create a data swath that is essentially equivalent to one printed by a substantially larger heater chip.

Preferably, the carrier is formed from a ceramic material. Because the ceramic carrier does not expand or contract significantly in response to temperature or humidity changes experienced during printing, the spacing between adjacent heater chips coupled to a single carrier does not vary significantly. Further, because"good" chips, i.e., chips which have passed quality control testing, are assembled to the carrier, higher manufacturing yields are achieved.

DETAILED DESCRIPTION OF PREFERRED EMBODIMENTS

Figure 1:
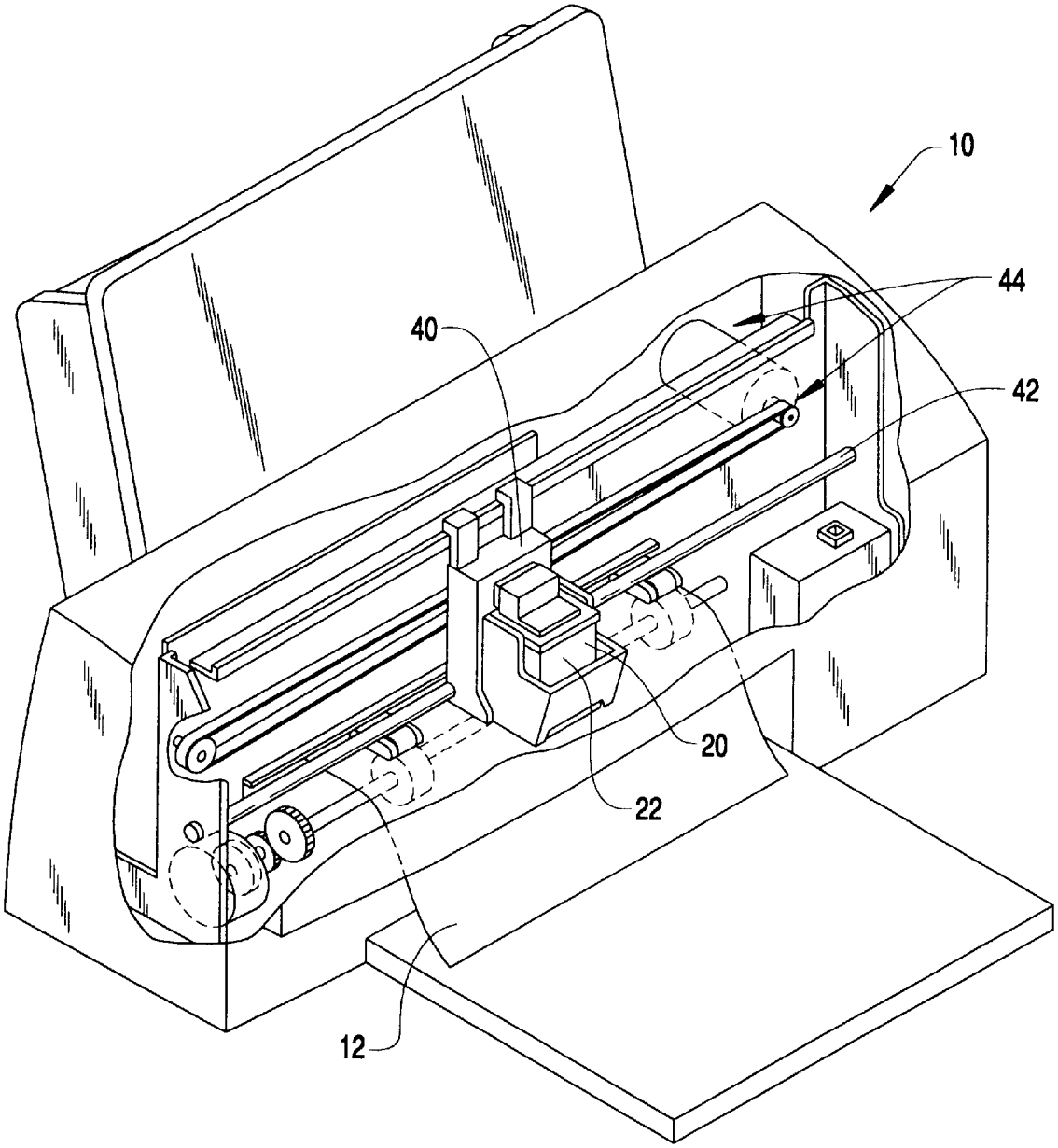
FIG. 1 is a perspective view, partially broken away, of an ink jet printing apparatus having a print cartridge constructed in accordance with the present invention.

Referring now to FIG. 1, there is shown an ink jet printing apparatus 10 having a print cartridge 20 constructed in accordance with the present invention. The cartridge 20 is supported in a carriage 40 which, in turn, is slidably supported on a guide rail 42. A drive mechanism 44 is provided for effecting reciprocating movement of the carriage 40 and the print cartridge 20 back and forth along the guide rail 42. As the print cartridge 20 moves back and forth, it ejects ink droplets onto a paper substrate 12 provided below it.

Figure 2:
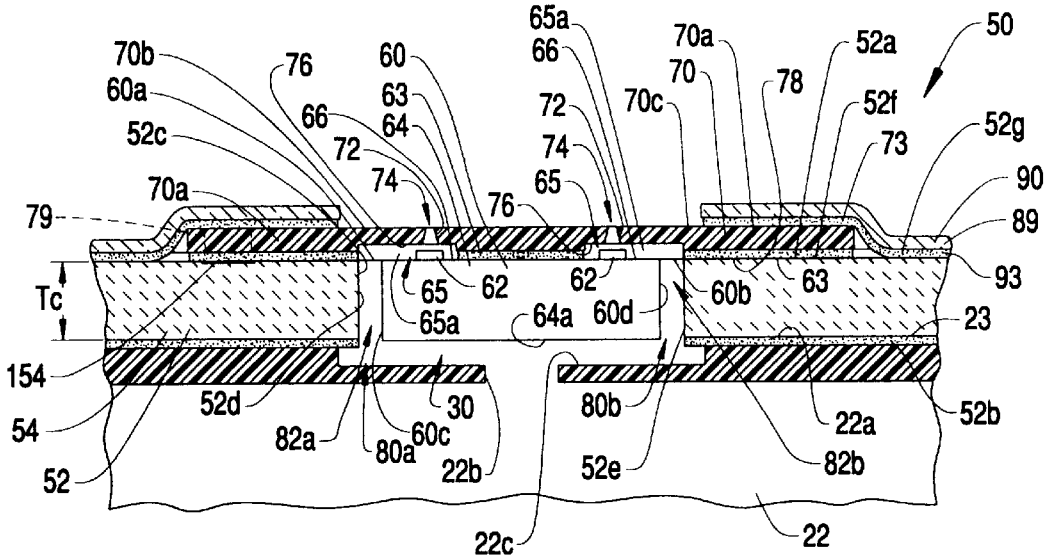
FIG. 2 is a cross sectional view of a portion of a heater chip module constructed in accordance with a first embodiment of the present invention.

The print cartridge 20 comprises a container 22, shown in FIGS. 1 and 2, filled with ink and a heater chip module 50, shown in FIG. 2. The container 22 may be formed from a polymeric material. In the illustrated embodiment, the container 22 is formed from polyphenylene oxide, which is commercially available from the General Electric Company under the trademark "NORYL SE-1." The container 22 may be formed from other materials not explicitly set out herein.

Referring now to FIG. 2, a heater chip module 50 is shown comprising a carrier 52, an edge-feed heater chip 60 and a nozzle plate 70. In the FIG. 2 embodiment, only a single heater chip 60 is provided. As will be discussed below with regard to the embodiment illustrated in FIG. 3, a single heater chip module may include two or more heater chips 60. The heater chip 60 includes a plurality of resistive heating elements 62 which are located on a base 64. In the illustrated embodiment, the base 64 is formed from silicon. The nozzle plate 70 has a plurality of openings 72 extending through it which define a plurality of nozzles 74 through which ink droplets are ejected. The carrier 52 is secured directly to a bottom side 22*a* of the container 22 by an adhesive 23. The adhesive 23 may comprise one which is commercially available from Emerson and Cuming Specialty Polymers, a division of National Starch and Chemical Company under the product designation "ECCOBOND 3193-17."

The nozzle plate 70 may be formed from a flexible polymeric material substrate which is adhered to the heater chip 60 via an adhesive 63. The adhesive 63 also bonds a portion 70*a* of the nozzle plate 70 to the carrier 52. Examples of polymeric materials from which the nozzle plate 70 may be formed and adhesives for securing the plate 70 to the heater chip 60 are set out in commonly assigned patent application, U.S. Ser. No. 08/966,281, entitled "METHOD OF FORMING AN INKJET PRINTHEAD NOZZLE STRUCTURE," by Ashok Murthy et al., filed on Nov. 7, 1997, which is a continuation-in-part application of patent application, U.S. Ser. No. 08/519,906, entitled "METHOD OF FORMING AN INKJET PRINTHEAD NOZZLE STRUCTURE," by Tonya H. Jackson et al., filed on Aug. 28, 1995, the disclosures of which are hereby incorporated by reference. As noted therein, the plate 70 may be formed from a polymeric material such as polyimide, polyester, fluorocarbon polymer, or polycarbonate, which is preferably about 15 to about 200 microns thick, and most preferably about 20 to about 80 microns thick. Examples of commercially available nozzle plate materials include a polyimide material available from E.I. DuPont de Nemours & Co. under the trademark "KAPTON" and a polyimide material available from Ube (of Japan) under the trademark "UPILEX." In the illustrated embodiment, the adhesive 63 comprises a layer of phenolic butyral adhesive coated over substantially the entire underside 78 of the nozzle plate 70. A polyimide substrate/phenolic butyral adhesive composite material is commercially available from Rogers Corporation, Chandler, Ariz., under the product name "RFLEX 1100."

When the plate 70 and the heater chip 60 are joined together, sections 76 of the plate 70 and portions 66 of the heater chip 60 define a plurality of bubble chambers 65. Ink supplied by the container 22 flows into the bubble chambers 65 through ink supply channels 65*a*. As is illustrated in FIG. 2, the supply channels 65*a* extend from the bubble chambers 65 beyond first and second outer edges 60*a* and 60*b* of the heater chip 60. The resistive heating elements 62 are positioned on the heater chip 60 such that each bubble chamber 65 has only one heating element 62. Each bubble chamber 65 communicates with one nozzle 74.

The carrier 52 comprises a rigid single layer substrate 54 formed from a material selected from the group consisting of ceramics, metals, silicon and polymers. In the illustrated embodiment, the substrate 54 is formed from a ceramic material such as alumina, zirconia, beryllia, aluminum nitride or another commercially available ceramic material. The single layer substrate 54 has a thickness $T_c$ of from about 300 microns to about 1000 microns and, preferably, from about 450 microns to about 800 microns.

The carrier 52 includes upper and lower surfaces 52*a* and 52*b* and a generally rectangular opening 52*c* which extends completely through the carrier 52. The opening 52*c* is defined by first, second, third and fourth inner side walls (only the first and second inner side walls 52*d* and 52*e* are illustrated in FIG. 2).

The nozzle plate 70 is sized so that a portion 70*a* of the plate 70 extends over a first section 52*f* of the upper surface 52*a* of the carrier 52. Hence, the plate 70 extends out beyond an outer periphery of the opening 52*c* so as to completely cover and seal the so opening 52*c*. The nozzle plate portion 70*a* is secured to the carrier section 52*f* via the adhesive 63.

As noted above, the heater chip 60 is bonded directly to the nozzle plate 70. The heater chip 60 is also positioned within the carrier opening 52*c*, which opening 52*c* has a periphery which is larger than the outer periphery of the heater chip 60. The heater chip 60 is not directly coupled to the carrier 52. It is only coupled to the carrier 52 by way of the nozzle plate 70. Thus, the heater chip 60 does not directly contact the carrier 52.

The carrier opening 52*c* and the heater chip 60 are sized such that opposing first and second sides 60*c* and 60*d* of the heater chip 60 are spaced from the first and second inner side walls 52*d* and 52*e* of the carrier 52 to form gaps 80*a* and 80*b* of a sufficient size to permit ink to flow freely between the chip side portions 60*c* and 60*d* and the first and second inner side walls 52*d* and 52*e* of the carrier 52. The third and fourth sides (not shown in FIG. 2) of the heater chip 60 are spaced from the third and fourth inner side walls (not shown in FIG. 2) of the carrier 52. The first side wall 60*c* of the heater chip 60, the first carrier inner side wall 52*d*, and a section 70*b* of the nozzle plate 70 define a first cavity 82*a* for receiving ink from the container 22. The second side 60*d* of the heater chip 60, the second carrier inner side wall 52*e*, and a second section 70*c* of the nozzle plate 70 define a second cavity 82*b* for receiving ink from the container 22. Ink from the container 22 passes through an opening 22*b* in the container 22 to an inner chamber 30 defined by a recessed outer portion 22*c* in the container and a lower surface 64*a* of the heater chip base 30 64. From the inner chamber 30, the ink flows into the first and second cavities 82*a* and 82*b* and then to the supply channels 65*a*.

The resistive heating elements 62 are individually addressed by voltage pulses provided by a printer energy supply circuit (not shown). Each voltage pulse is applied to one of the heating elements 62 to momentarily vaporize the ink in contact with that heating element 62 to form a bubble within the bubble chamber 65 in which the heating element 62 is located. The function of the bubble is to displace ink within the bubble chamber 65 such that a droplet of ink is expelled from a nozzle 74 associated with the bubble chamber 65.

A flexible circuit 90, secured to the container 22 and the carrier 52, is used to provide a path for energy pulses to travel from the printer energy supply circuit to the heater chip 60. The flexible circuit 90 may comprise a substrate portion 89 having metallic traces formed on its lower surface, such as described in copending patent application U.S. Ser. No. 08/827,140, entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL," filed Mar. 27, 1997, the disclosure of which is incorporated herein by reference. End sections 91 (shown only schematically in FIG. 3) of the traces on the flexible circuit 90 are TAB bonded to bond pads (not shown) on the heater chip 60, such as described in the above referenced patent application, U.S. Ser. No. 08/827,140. The end sections 91 pass through windows 71 provided in the nozzle plate 70 so as to contact the bond pads on the heater chip, see the embodiment illustrated in FIG. 3. Sections of the traces may also be wired bonded to the bond pads on the heater chip. Wire bonding may be effected in the manner discussed in contemporaneously filed patent application entitled "AN INK JET HEATER CHIP MODULE WITH SEALANT MATERIAL," which has previously been incorporated herein by reference. Current flows from the printer energy supply circuit to the traces on the flexible circuit 90 and from the traces to the bond pads on the heater chip 60. Conductors (not shown) are formed on the heater chip base 64 and extend from the bond pads to the heating elements 62. The current flows from the bond pads along the conductors to the heating elements 62.

One or two or more openings 52*c* may be formed in a single carrier 52 such that the single carrier is capable of receiving two or more heater chips 60. In the embodiment illustrated in FIG. 3, where like elements are referenced by like reference numerals, two openings 52*c* are provided in the carrier 152. Each opening 52*c* receives a single heater chip 60. Each heater chip 60 is provided with a single nozzle plate 70. Alternatively, a single nozzle plate (not shown) which extends over and is bonded to both heater chips 60 may be provided. It is also contemplated that two or more heater chips 60 may be provided in a single opening 52*c* and secured to a single nozzle plate 70. When two or more heater chips 60 are provided, they may be positioned side by side, end to end or offset from one another.

Figure 3:
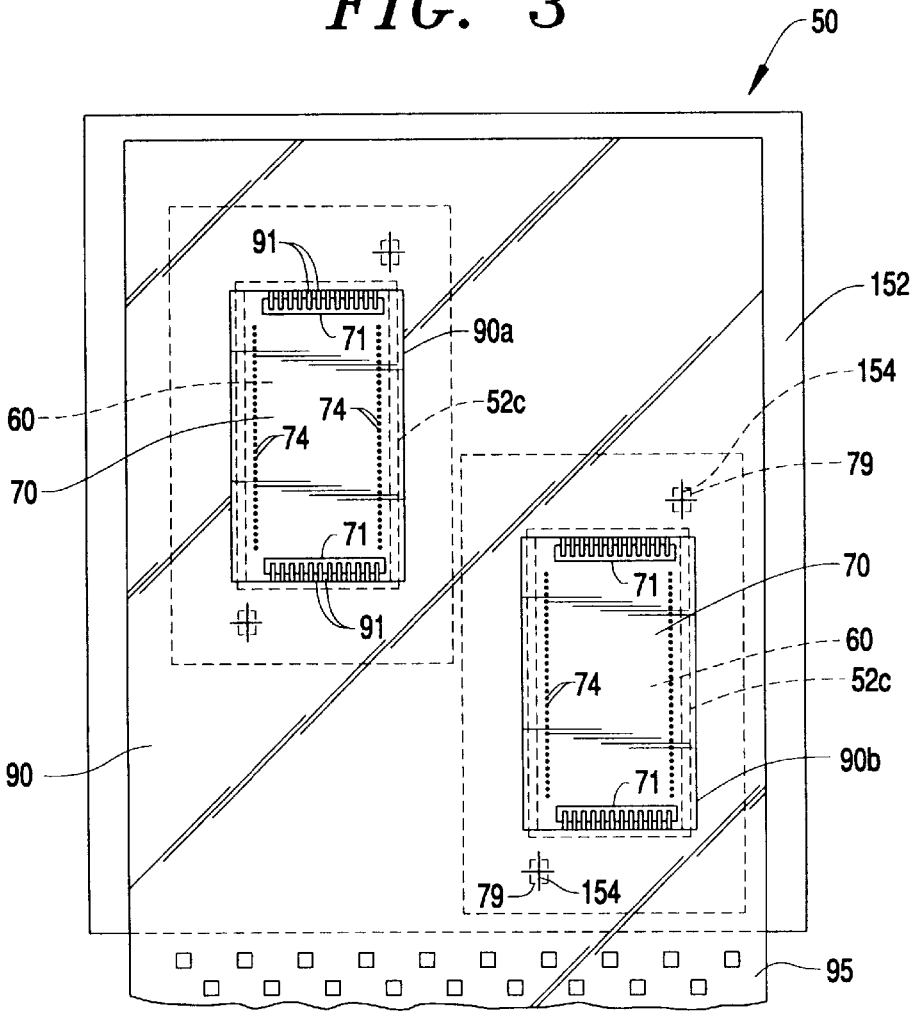
FIG. 3 is a plan view of a heater chip module constructed in accordance with a second embodiment of the present invention.

In the embodiment illustrated in FIG. 3, only a single flexible circuit 90 is provided having first and second windows 90*a* and 90*b* exposing the two nozzles plates 70 coupled to the carrier 52. Alternatively, two flexible circuits 90 may be provided, one for each of the two heater chips 60.

The process for forming the heater chip module 50 illustrated in FIG. 2 will now be described. As noted above, the nozzle plate 70 comprise a flexible polymeric material substrate. In the illustrated embodiment, the flexible substrate is provided with an overlaid layer of phenolic butyral adhesive for securing the nozzle plate 70 to the heater chip 60 and the carrier 52.

Initially, the nozzle plate 70 is aligned with and mounted to the heater chip 60. At this point, the heater chip 60 has been separated from other heater chips 60 formed on the same wafer. Alignment may take place as follows. One or more first fiducials (not shown) may be provided on the nozzle plate 70 which are aligned with one or more second fiducials (not shown) provided on the heater chip 60. After the nozzle plate 70 is aligned with and located on the heater chip 60, the plate 70 is tacked to the heater chip 60 using, for example, a conventional thermocompression bonding process. The phenolic butyral adhesive 63 on the nozzle plate 70 is not cured after the tacking step has been completed.

The nozzle plate/heater chip assembly is then mounted to the carrier 52. Initially, the heater chip 60 is aligned with and mounted to the carrier 52 such as by aligning two or more fiducials 154 formed on the carrier 52 with a like number of openings 79 provided in the nozzle plate 70. The fiducials 154 may be viewed using, for example, a video microscope (not shown) which generates an output signal provided to either a monitor for analysis by human vision or to an optical analyzer for analysis by an electronic device. It is also contemplated that an operator may view the fiducials 154 through an eyepiece of a standard microscope. Alternatively, alignment may be effect in the manner described in the patent application entitled "AN MK JET HEATER CHIP MODULE," previously incorporated herein by reference. The nozzle plate/heater chip assembly is then tacked to the carrier 52 via a conventional thermocompression bonding process so as to maintain the assembly and the carrier 52 joined together until the adhesive 63 is cured.

Next, the nozzle plate/heater chip assembly and carrier 52 are heated in an oven at a temperature and for a time period sufficient to effect the curing of the phenolic butyral adhesive 63 that bonds the nozzle plate 70 to the heater chip 60 and the carrier 52.

After the nozzle plate 70 has been bonded to the heater chip 60 and the carrier 52, an adhesive material 93 is placed over a second section 52*g* of the upper surface 52*a* of the carrier 52 and a section 73 of the nozzle plate 70 to which the flexible circuit 90 is to be secured. Preferably, the adhesive material 93 is capable of withstanding a temperature equal to or greater than about 185° C. such that it does not cure during a subsequent TAB bonding process. After the adhesive material 93 is placed on the carrier 52 and the nozzle plate 70, the flexible circuit 90 is positioned over the adhesive material 93 and tacked to the carrier 52 and the nozzle plate 70 using a conventional thermal compression bonding process.

After the flexible circuit 90 has been tacked to the carrier 52 and the nozzle plate 70, end sections (not shown in FIG. 2) of the traces (not shown in FIG. 2) on the flexible circuit 90 are TAB bonded to the bond pads (not shown) on the heater chip 60.

The nozzle plate/heater chip assembly, carrier 52 and flexible circuit 90 are then heated in an oven at a temperature and for a time period sufficient to effect the curing of the adhesive material 93 that bonds the flexible circuit 90 to the nozzle plate 70 and the carrier 52.

Alternatively, an adhesive film, such as a phenolic butyral adhesive, one of which is commercially available from Rogers Corporation, Chandler, Ariz., or another B-staged crosslinkable free standing film, is inserted between the flexible circuit 90 and the carrier/nozzle plate assembly after TAB bonding has been effected. The flexible circuit 90 is then tacked to the carrier/nozzle plate assembly via a conventional thermocompression bonding process. Thereafter, the carrier/nozzle plate assembly and the flexible circuit 90 are heated in an oven at a temperature and for a time period sufficient to effect the curing of the adhesive film.

After the flexible circuit 90 has been bonded to the nozzle plate 70 and the carrier 52, a liquid encapsulant material (not shown), such as an ultraviolet (UV) curable adhesive, one of which is commercially available from Emerson and Cuming Specialty Polymers, a division of National Starch and Chemical Company under the product designation "UV9000," is applied over the trace sections, the bond pads and the nozzle plate windows 71 so as to substantially cover and seal the trace sections, the bond pads and the windows 71. The UV adhesive is then cured using ultraviolet light.

The heater chip module 50, which comprises the nozzle plate/heater chip assembly and the carrier 52, and to which the flexible circuit 90 is bonded, is aligned with and bonded to a polymeric container 22. An adhesive (not shown) such as one which is commercially available from Emerson and Cuming Specialty Polymers, a division of National Starch and Chemical Company under the product designation "ECCOBOND 3193-17" is applied to a portion of the container where the module 50 is to be located. The module 50 is then mounted directly to the container portion. No other element is located between the module 50 and the container 22 except for the adhesive that bonds the two elements together.

Next, the heater chip module 50 and container 22 are heated in an oven at a temperature and for a time period sufficient to effect the curing of the adhesive which joins the module 50 to the container 22.

A portion 95 of the flexible circuit 90 which is not joined to the carrier 52 is bonded to the container 22 by, for example, a conventional free-standing pressure sensitive adhesive film, such as described in copending patent application U.S. Ser. No. 08/827,140, entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL," filed Mar. 27, 1997, the disclosure of which is incorporated herein by reference.

What is claimed is:

1. A heater chip module comprising:

a rigid carrier adapted for being secured to a container for receiving ink, said carrier including an opening extending completely through said carrier, said opening having an outer periphery;

a nozzle plate coupled to said carrier and extending to beyond the outer periphery of said opening so as to substantially cover said opening; and a heater chip positioned within said opening attached only by adherence to said nozzle plate and not otherwise supported by said carrier.

2. A heater chip module as set forth in claim 1, wherein said rigid carrier is formed from a material selected from the group consisting of ceramics, metals, silicon and polymers.

3. A heater chip module as set forth in claim 1, wherein said heater chip is an edge feed heater chip.

4. A heater chip module as set forth in claim 3, wherein said carrier opening is defined by inner side walls, said carrier opening and said edge feed heater chip are sized and positioned so that at least one side wall of said heater chip is spaced from at least one of said inner side walls of said carrier, and said at least one inner side wall of said carrier, said at least one side wall of said heater chip and a section of said nozzle plate define a cavity for receiving ink from the container.

5. An ink jet print cartridge comprising:

an ink-filled container;

a heater chip module including a rigid carrier, a first nozzle plate and a first heater chip, said carrier being attached directly to said container and including a first opening extending completely through said carrier, said first opening having a first outer periphery, said first nozzle plate being coupled to said carrier and extending to beyond said first outer periphery so as to substantially cover said first opening, and said first heater chip being positioned within said opening attached only by adherence to said nozzle plate and not otherwise supported by said carrier; and a flexible circuit coupled to said heater chip.

6. An ink jet print cartridge as set forth in claim 5, wherein said heater chip comprises an edge feed heater chip.

7. An ink jet print cartridge as set forth in claim 6, wherein said first opening is defined by first inner side walls, said carrier first opening and said first edge feed heater chip are sized such that at least one side wall of said first heater chip is spaced from at least one of said first inner side walls of said carrier, and said at least one inner side wall of said carrier, said at least one side wall of said heater chip and a section of said first nozzle plate defining a first cavity for receiving ink from said container.

8. An ink jet print cartridge as set forth in claim 6, wherein said flexible circuit comprises a substrate portion and at least one conductor trace associated with said substrate portion, said at least one conductor trace having a section which is coupled to a bond pad on said first heater chip.

9. An ink jet print cartridge as set forth in claim 8, wherein said conductor trace section is TAB bonded to said bond pad.

10. An ink jet print cartridge as set forth in claim 5, wherein said carrier is formed from a material selected from the group consisting of ceramics, metals, silicon and polymers.

11. An ink jet print cartridge as set forth in claim 5, wherein said carrier includes a second opening extending completely through said carrier, said second opening having a second outer periphery, and said heater chip module further including a second nozzle plate coupled to said carrier and extending out beyond said second outer periphery of said second opening so as to substantially cover said second opening, and a second heater chip positioned within said second opening and coupled to said second nozzle plate.

12. An ink jet print cartridge as set forth in claim 11, wherein said second heater chip comprises an edge feed heater chip.

13. An ink jet print cartridge as set forth in claim 12, wherein said second opening is by second inner side walls, said carrier second opening and said second edge feed heater chip are sized such that at least one side wall of said second heater chip is spaced from at least one of said second inner side walls of said carrier, and said at least one second inner side wall of said carrier, said at least one side wall of said second heater chip and a section of said second nozzle plate defining a second cavity for receiving ink from said container.

* * * * *